US005248061A

United States Patent [19]

Weiselfish et al.

[11] Patent Number: 5,248,061

[45] Date of Patent: Sep. 28, 1993

[54] APPARATUS FOR AUTOMATICALLY DISPENSING FLOWABLE MATERIAL

[75] Inventors: Jacob Weiselfish, West Hartford, Conn.; Yair Kipman, Waltham, Mass.

[73] Assignee: Apparel Technology Systems, Inc., South Windsor, Conn.

[21] Appl. No.: 669,927

[22] Filed: Mar. 15, 1991

[51] Int. Cl.[5] ..... B67D 5/08; B65D 35/28

[52] U.S. Cl. ..... 222/63; 222/100; 222/333

[58] Field of Search ..... 222/63, 102, 98, 333, 222/101, , 97, 99, 638, 644, 100

[56] References Cited

U.S. PATENT DOCUMENTS

| | | | |
|---|---|---|---|
| 4,132,330 | 1/1979 | Rauscher et al. | 222/100 |
| 4,234,104 | 11/1980 | Apuzzo et al. | 222/333 X |
| 4,258,864 | 3/1981 | Karamanolis et al. | 222/333 X |
| 4,264,021 | 4/1981 | Davis, Jr. | 222/333 |
| 4,421,251 | 12/1983 | Namdari et al. | 222/99 |
| 4,473,173 | 9/1984 | DeGroff et al. | 222/63 |
| 4,850,513 | 7/1989 | Porter | 222/63 X |
| 4,955,507 | 9/1990 | Kirschner et al. | 222/63 |
| 4,998,645 | 3/1991 | Pearson | 222/98 |
| 5,050,773 | 9/1991 | Choi | 222/102 X |

*Primary Examiner*—Donald T. Hajec
*Attorney, Agent, or Firm*—Morgan & Finnegan

[57] ABSTRACT

An apparatus for automatically dispensing flowable material which automatically ensures a substantially constant and even supply of flowable material from a source of the flowable material to some destination at which the flowable material needed or is used. The flowable material may be any material that can be extruded from a collapsible tube upon the exertion of pressure on the tube and includes liquids or gels. The apparatus comprises a collapsible tube having a nozzle end and a sealed end and containing a flowable material; a tube squeezer; a rotatable drum for pulling the collapsible tube through the tube squeezer as the drum rotates; a motor for rotating the drum; and an electronic feedback mechanism for disengaging the motor so as to maintain pressure of the flowable material within a selected pressure range and the supply of flowable material to a destination is substantially even and constant.

10 Claims, 4 Drawing Sheets

APPARATUS FOR AUTOMATICALLY DISPENSING FLOWABLE MATERIAL

BACKGROUND OF THE INVENTION

The present invention relates to an automatic flowable material dispensing apparatus which in a preferred embodiment relates to an apparatus for dispensing ink to a plotter.

Plotters require a steady and constant supply of ink for operation. An undersupply or oversupply of ink may render plotter operation unacceptable. An oversupply of ink is undesirable because the excess ink may cause blots on the plot or cause the plot to be inaccurate or illegible. An undersupply of ink is undesirable because without a sufficient ink supply, portions or all of a plot may be lost.

The use of disposable pen cartridges as the ink supply source is problematic because a plotter so equipped must be continuously monitored to ensure that the pen cartridge has not run out of ink. A worker is required to monitor the plotter and to replace the disposable pen cartridge when depleted. If a plotter is to be used over a long time when constant monitoring is not feasible, a new disposable pen cartridge must be installed as a precaution against a partially depleted cartridge being fully depleted at some point during the long time period. As the partially depleted cartridge is usually discarded, this method of operation is economically disadvantageous.

Pressurized ink supply systems are also known. However, such a system results in an uneven flow of ink to the plotter pen, thereby producing unacceptable plots. Such a pressurized ink supply system may render the plotter pen inoperable and may even cause the plotter pen to explode.

SUMMARY OF INVENTION

The present invention encompasses an apparatus for automatically dispensing flowable material. It is an object of the present invention to automatically ensure a substantially constant and even supply of flowable material from a source of the flowable material to some destination at which the flowable material needed or is used.

The flowable material is originally contained in a collapsible tube. Such collapsible tubes are well known and may be constructed from a number of different materials including for example, plastic, metal and rubber. The flowable material may be any material that can be extruded from a collapsible tube upon the exertion of pressure on the tube. Such flowable materials can be solids, liquids or gels and may include, for example, lubricants, paint, pigments, toothpaste and ink.

The apparatus of the present invention may be used, for example, to provide a constant and even supply of lubricant to the ball bearings of a rotatable apparatus or an even supply of any flowable material to the locus where such a material is used or required.

In a preferred embodiment of the present invention, ink can be dispensed from a collapsible tube to a plotter pen in a substantially steady and constant rate, for example, within the pressure range necessary to ensure acceptable plotter pen operation.

The apparatus of present invention comprises: a collapsible tube having a nozzle end and a sealed end and containing a flowable material; a tube squeezer; a rotatable drum for pulling the collapsible tube through the tube squeezer as the drum rotates; motor means for rotating the drum; and feedback means for disengaging the motor means so as to maintain pressure of the flowable material within a selected pressure range. The feedback means associated with the motor means regulates the operation of the motor means, controls the dispensing of the flowable material from the collapsible tube and allows for a substantially steady and relatively constant rate of extrusion of the flowable material from the tube.

A collapsible tube of a flowable material, which is connected to a suitable means for carrying the flowable material to the desired locus where the material is required or used, is loaded into the apparatus by inserting the sealed end of the tube through the tube squeezer and connecting the sealed end to the rotatable drum. The flowable material is extruded from the collapsible tube and to the locus of use or need by rotating the drum thereby pulling the collapsible tube through the tube squeezer. The drum is rotated by a motor means which can be, for example, a DC motor.

As the amount of flowable material being squeezed from the tube exceeds the amount needed at the locus where the flowable material is needed or used, the pressure of the flowable material in the tube will increase. The motor means which rotates the drum will be acting against this increased pressure and will draw an increasing amount of current. The current drawn by the DC motor is proportional to the pressure of the ink at the nozzle end of the tube. A feedback means monitors the current drawn by the DC motor and disengages the DC motor if the current equals or exceeds a preselected value corresponding to maximum desired ink pressure.

In the preferred embodiment of the present invention, a collapsible tube of ink is connected to the plotter pen by a flexible tubing and is loaded into the apparatus by inserting the sealed end of the tube through the tube squeezer and connecting the sealed end to the rotatable drum. The ink is forced from the collapsible tube to the pen by rotating the drum thereby pulling the collapsible tube through the tube squeezer. The drum is rotated by a motor means such as a DC motor and the feedback means controls the motor so as to ensure a substantially constant and steady supply of ink through the flexible tubing to the plotter.

The current drawn by the DC motor is proportional to the pressure of the ink at the nozzle end of the tube. A feedback means monitors the current drawn by the DC motor and disengages the DC motor if the current equals or exceeds a preselected value corresponding to maximum desired ink pressure.

DETAILED DESCRIPTION OF THE DRAWING AND THE INVENTION

Figure 1:
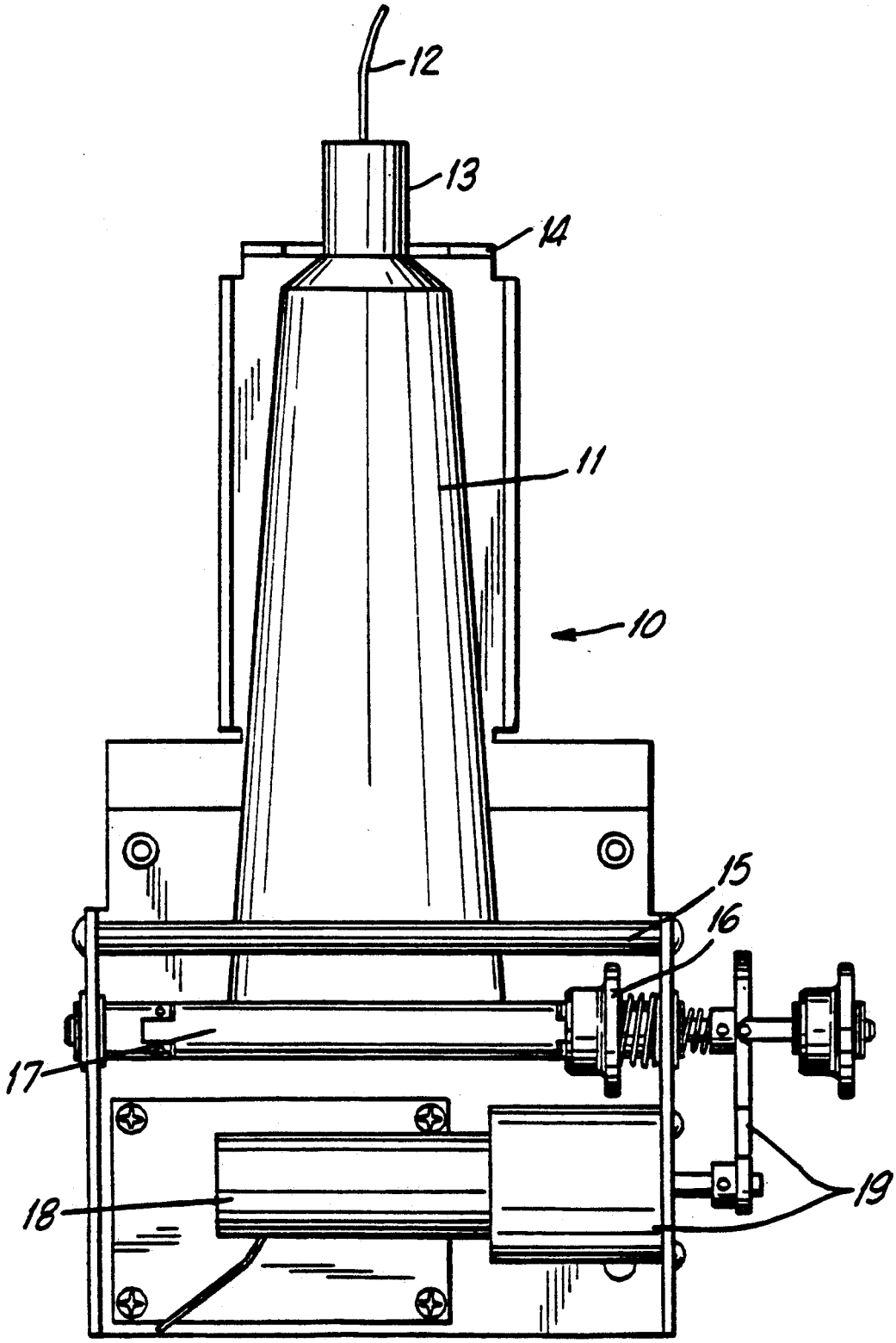
FIG. 1 is a schematic illustration of an apparatus for dispensing ink to a plotter.

FIG. 1 illustrates an apparatus 10 for dispensing ink to a plotter according to the present invention. The ink to be dispensed to the plotter pen is originally contained in a collapsible tube 11, which is preferably on ATS-1 ink tube. Tubing 12 is connected to the nozzle end 13 of the collapsible tube 11 and to the plotter pen so as to provide a pathway for the ink to be dispensed from the collapsible tube 11 to the plotter pen.

Figure 2:
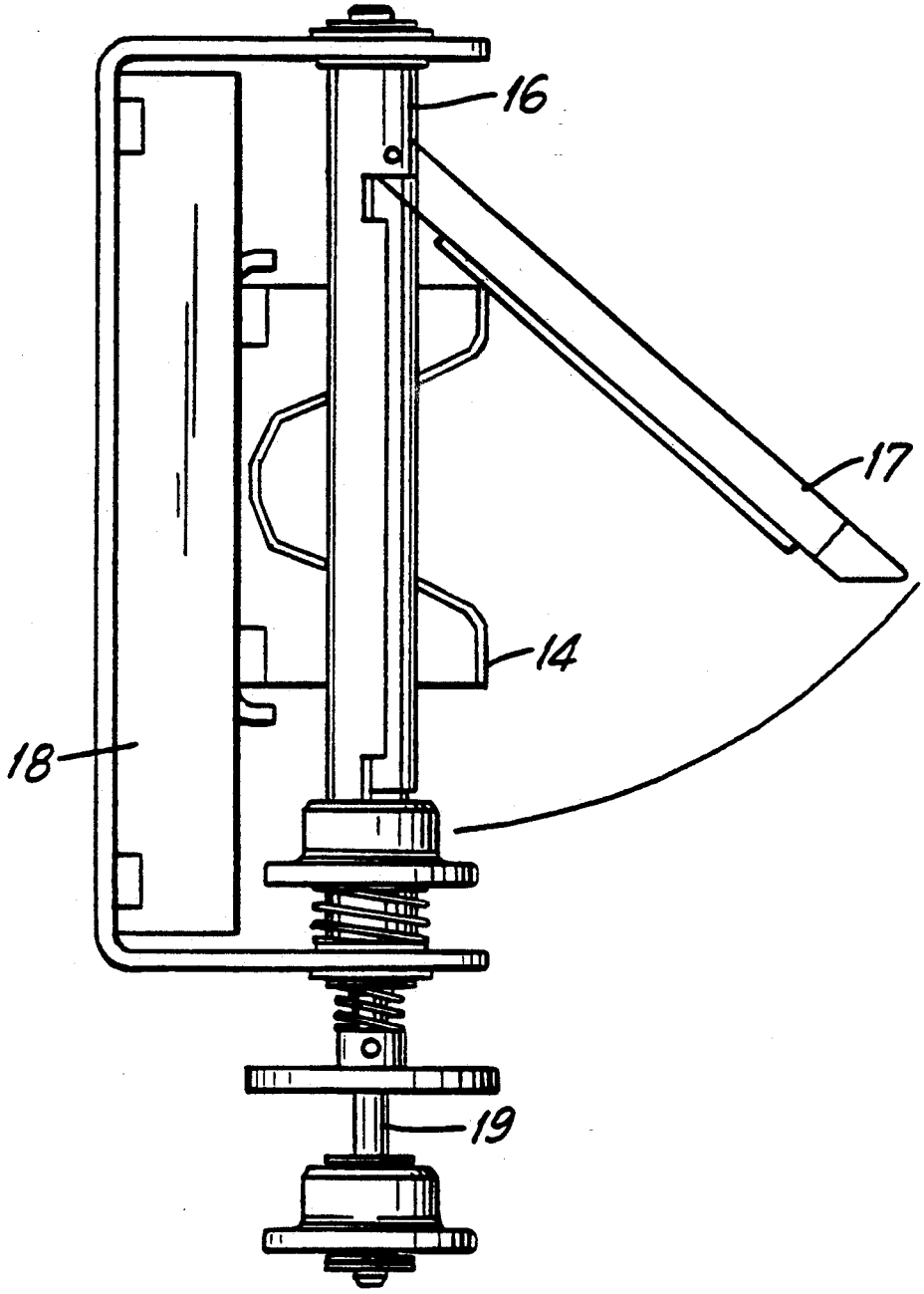
FIG. 2 is a rear view of the apparatus depicted in FIG. 1.

The collapsible tube 11 is loaded into the apparatus 10 by placing the nozzle end of the tube 11 on the tube holder 14 and inserting the sealed end 13 of the tube through the tube squeezer 15 and connecting the sealed end to the rotatable drum 16. As depicted in FIG. 2, the sealed end may be connected to the rotatable drum 16 by a tube catcher 17 which is pivotally connected to the rotatable drum 16. The tube catcher 17 clamps the sealed end to the rotatable drum 16.

By rotating the rotatable drum 16, the collapsible tube 11 is drawn through the tube squeezer 15 thereby forcing the ink from the end portion towards the nozzle end 13 of tube 11. The ink at the nozzle end 13 is consequently dispensed to the plotter pen (not shown) by way of tubing 12. The rotation of drum 16 causes the depleted portion of tube 11 to wrap around drum 16. Drum 16 is rotated by motorized means 18, preferably a reversible twelve volt DC motor, Which is connected to the drum 16 by a linkage 19.

If the amount of ink squeezed from the end portion of tube 11 exceeds the amount of ink being used by the plotter pen, the pressure of the ink at the nozzle end of tube 11 will increase. This increased pressure poses a greater load for the motor 18. Consequently, the motor 18 will draw an increasing current in proportion to the increasing ink pressure. A feedback means 30 monitors the current drawn by the motor 18 and disengages the motor 18 when the current exceeds a preselected value corresponding to the maximum desired ink pressure.

Figure 3:
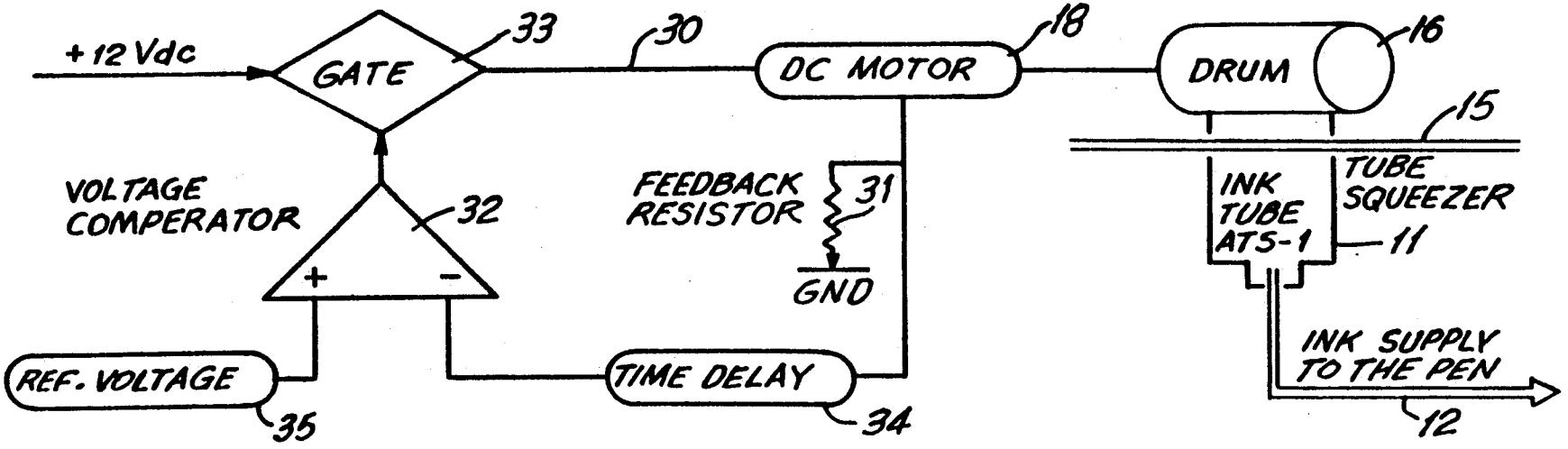
FIG. 3 is a block diagram of electrical circuit employed to monitor and control the dispensing of ink by the apparatus depicted in FIGS. 1 and 2.

The feedback means 30 is depicted in FIG. 3. The current being drawn by the motor 18 is passed across a feedback resistor 31, which preferably is a 4.7 ohm resistor. The obtained voltage is then compared to a reference voltage by voltage compensator 32. Preferably, the reference voltage is 1.2 volts. If the voltage obtained across the feedback resistor 31 equals or exceeds the reference voltage, an electrical gate 33 disengages the power supply to the motor 18. At that point, further pressurization of the ink ceases.

The feedback means 30 includes a time delay 34 whereby the power supply will be reconnected to the motor 18 after a time period selected by the user has elapsed. Preferably, the time delay period is fifteen minutes. As soon as the power supply (not shown) is reconnected to the motor 18, the drum 16 will begin to rotate thereby displacing ink from the end portion of tube 11. After a slight time lag, the feedback means 30 is reengaged to monitor and control the pressurization of the ink supply. If the plotter pen has not dispensed ink and thereby relieved the ink pressure during the time delay period, an overpressurization condition may develop over numerous cycles due to the incremental pressure increase developed over each cycle because of the time lag for engaging the feedback means 30.

A more preferred embodiment precludes the possibility of this overpressurization situation occurring by reversing the motor 18 for one or two seconds after the obtained voltage across feedback resistor 31 exceeds the reference voltage 35 but before the power supply (not shown) to the motor 18 is disengaged. The reversal of the DC motor 18 slightly unwinds the depleted portion of tube 11 from drum 16. After the time delay has elapsed and the power supply is reconnected to the DC motor, the feedback mechanism 30 will be re-engaged before the unwinding of the depleted portion of tube 11 is compensated for. This more preferred embodiment will dispense a steady and even supply of ink to the plotter pen within a range of 10–20 pounds per square inch under all operating conditions.

A tube position monitoring means may be provided to notify the operator of the near complete depletion of ink from collapsible tube 11. The ink is forced from tube 11 by drawing tube 11 through tube squeezer 15. As the depleted portion of tube 11 is wrapped around drum 16, the nozzle end 13 progresses towards the fixed tube squeezer 15. A position indication circuitry will provide an alarm when the nozzle end 13 is in the immediate vicinity of the tube squeezer 15.

Figure 4:
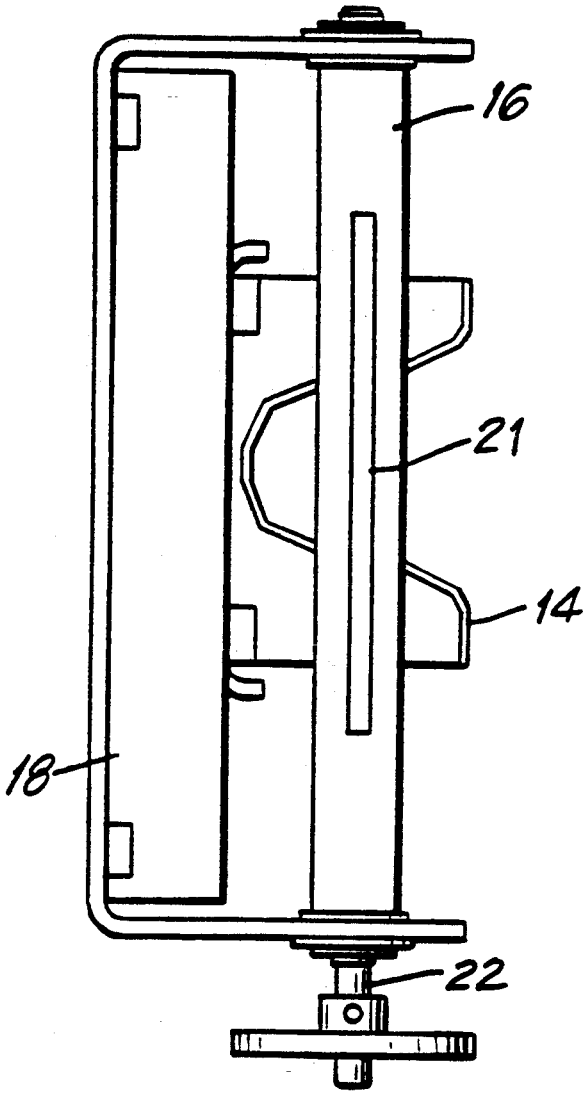
FIG. 4 is a rear view of the apparatus having another means for connecting the tube to the drum.

An alternate method of connecting the collapsible tube 11 to the drum 16 is shown in FIG. 4. In this embodiment, the means for holding the tube 11 on the drum 16 is a slot 21 in the drum into which the end of the tube 11 can be inserted and held as the drum 16 rotates. Additionally, FIG. 4 shows the use of a modified linkage 22 in which the spring-loaded means of FIGS. 1 and 2 are not employed.

What is claimed:

1. An apparatus for automatically dispensing and ensuring a substantially constant and even supply of flowable material to a destination wherein the flowable material is contained in a collapsible tube having a nozzle end and a sealed end, said apparatus comprising:

a tube squeezer;

a rotatable drum;

connecting means for connecting the sealed end of the collapsible tube to the rotatable drum so that the collapsible tube can be drawn through the tube squeezer as the drum rotates;

motor means for rotating the drum; and feedback means associated with the motor means for regulating the operation of the motor means, and for controlling the dispensing of flowable material from the collapsible tube such that the supply of the flowable material to the destination is automatically constant and even.

2. The apparatus of claim 1, wherein the connecting means is a tube catcher which is pivotally connected to the rotatable drum.

3. The apparatus of claim 1, wherein the connecting means is a slot into which the sealed end of the tube can be inserted.

4. The apparatus of claim 1, wherein the motor means is a DC motor linked to the rotatable drum.

5. The apparatus of claim 4, wherein the motor means is a reversible DC motor.

6. The apparatus of claim 1, wherein the motor means is a 12 volt reversible DC motor linked t the rotatable drum.

7. The apparatus of claim 1, further comprising a means for indicating near complete depletion of flowable material from the collapsible tube.

8. The apparatus of claim 1, wherein the feedback means comprises:

a feedback resistor across which current drawn by the DC motor is passed;

a reference voltage source;

a voltage comparator for comparing the reference voltage and voltage obtained across the feedback resistor;

an electrical gate for disengaging a power supply to the motor means if the voltage across the feedback resistor equals or exceeds the reference voltage; and a time delay means for re-engaging the power supply to the motor means after a selected time period has elapsed.

9. The apparatus of claim 8, wherein the motor means is a 12 volt DC motor, the feedback resistor is a 4.7 ohm resistor, and the reference voltage is 1.2 volts.

10. The apparatus of claim 9, wherein the feedback means further comprises a means for reversing the DC motor for a short period of time after the voltage across the feedback resistor equals or exceeds the reference voltage and before the power supply to the DC motor is disengaged.

* * * * *